US005572933A

United States Patent [19]

Thompson

[11] Patent Number: 5,572,933

[45] **Date of Patent: * Nov. 12, 1996**

[54] SAFETY LOCKING SYSTEM FOR AIR-OPERATED TILT TABLES

[75] Inventor: Ronald J. Thompson, Holland, Mich.

[73] Assignee: International Material Control Systems Inc., Zeeland, Mich.

[ * ] Notice: The term of this patent shall not extend beyond the expiration date of Pat. No. 5,431,112.

[21] Appl. No.: 500,705

[22] Filed: Jul. 11, 1995

Related U.S. Application Data

[63] Continuation-in-part of Ser. No. 220,749, Mar. 31, 1994, Pat. No. 5,431,112.

[51] Int. Cl.[6] ..... A47F 5/12

[52] U.S. Cl. ..... 108/7; 248/396; 297/284.11; 297/328; 297/DIG. 8; 5/615

[58] Field of Search ..... 108/7, 1, 6; 248/396, 248/394, 397; 297/284.11, 313, 328, DIG. 8; 5/614, 615, 634

[56] References Cited

U.S. PATENT DOCUMENTS

| | | | |
|---|---|---|---|
| 743,344 | 11/1903 | Souder et al. | 108/6 |
| 1,859,456 | 5/1932 | Nestler | 108/2 |
| 3,004,812 | 10/1961 | Miller | 5/614 |
| 3,198,575 | 8/1965 | Hawkins | 297/328 |
| 3,213,809 | 10/1965 | Kritske | 108/2 |
| 3,358,620 | 7/1966 | Parigi | 108/6 |
| 3,599,963 | 8/1971 | Grover | 5/614 |
| 3,638,584 | 2/1972 | Cisler et al. | 108/6 |
| 3,825,244 | 7/1974 | Bauer | 267/124 |
| 3,874,309 | 4/1975 | Cowley | 108/2 |
| 4,180,002 | 12/1979 | Huempfner | 108/6 |
| 4,365,561 | 12/1982 | Tellier et al. | 108/7 |
| 4,462,579 | 7/1984 | Satake | 108/7 |
| 4,605,189 | 8/1986 | Bruneau | 248/162.1 |
| 4,734,945 | 4/1988 | Wright | 5/11 |
| 4,839,932 | 6/1989 | Williamson | 5/615 |
| 5,005,669 | 4/1991 | Umebara et al. | 108/6 |
| 5,014,378 | 5/1991 | Sato | 5/453 |
| 5,131,333 | 7/1992 | Karasawa et al. | 108/7 |
| 5,243,921 | 9/1993 | Kruse et al. | 100/147 |

FOREIGN PATENT DOCUMENTS

| | | | |
|---|---|---|---|
| 75842 | 4/1984 | Japan | 297/284.11 |
| 230833 | 12/1984 | Japan | 297/284.11 |

*Primary Examiner*—Peter M. Cuomo
*Assistant Examiner*—Janet M. Wilkens
*Attorney, Agent, or Firm*—Waters & Morse, P.C.

[57] ABSTRACT

A tiltable table has a pneumatic actuator and a locking system for establishing and maintaining a table position. The locking system is operated by an air cylinder that engages a dog with a ratchet plate secured to the table. The ratchet permits the table to be raised but not lowered while locked. The ratchet must be unlocked before the table can be lowered. The dog is spring-biased to locking position, and is air-operated for release against the action of the biasing spring. On lowering the table, air from the actuator can be used to unlock the ratchet. The air can be permitted to escape through a restriction orifice at a slow enough rate to maintain sufficient air pressure to keep the locking system disengaged, but sudden release of all the air pressure will again permit the spring to re-lock the system to prevent a downward slamming of the table surface.

4 Claims, 4 Drawing Sheets

SAFETY LOCKING SYSTEM FOR AIR-OPERATED TILT TABLES

CROSS REFERENCE TO RELATED APPLICATION

This application is a continuation-in-part of applicant's co-pending patent application, Ser. No. 8/220,749, filed Mar. 31, 1994, now U.S. Pat. No. 5,431,112, issued Jul. 11, 1995.

RELATED FIELD

This invention relates to the actuating system for power-operated tilt tables.

BACKGROUND OF THE INVENTION

Many types of equipment involve inclinable table surfaces. Industrial operations often require objects to be tilted or elevated, and hospital equipment must frequently be capable of supporting a patient in an inclined position. Considerable weight may have to be supported in both cases, which has led to power-actuated systems subject to the control of an operator. Air (pneumatic) and liquid (hydraulic) systems for actuating and positioning the moveable table surface are frequently used, depending on the requirements of the particular application. A general term covering both systems would be "fluid"-operated. Compressed air provides quicker action, and less leakage problem, but is compressible. Hydraulic operation is therefore more appropriate where positive positioning by the actuator alone is required. The greater simplicity of the pneumatic system provides an inducement to include some sort of positive positioning for the air-operated actuator. The addition of fail-safe characteristics also increases the number of applications that can utilize the advantage of the pneumatic system. Rupture of an air conduit or air bag actuator is then no longer a hazard.

SUMMARY OF THE INVENTION

The preferred form of the present invention, because of its simplicity, utilizes an accordion-type air bag as an actuator. A tiltable table panel is pivotally mounted on a convenient base structure, and the air bag is adapted to apply force between these components. An arcuate ratchet plate is preferably mounted on the table panel coaxially with the table pivot. A ratchet dog is slidably supported in a guideway carried by the base structure in position to move into and out of engagement with the ratchet plate to lock the position of the tiltable panel. An air cylinder, also mounted on the base structure, has a piston rod connected to the dog to position it. A spring in the cylinder biases the piston to urge the dog to locking position, and an air inlet in the cylinder is located so that air pressure is operable to unlock the dog. This air inlet is in parallel with the exhaust from the air bag, and both are under the control of a selector valve. Exhaust from the air bag is directed through a restricted orifice to slow the deflation of the air bag when the selector valve is set to provide an exhaust passage (corresponding to lowering the table). This provides enough remaining pressure in the air conduit from the air bag to overcome the biasing spring to keep the dog unlocked during the period in which the table is returning to a horizontal position. A blow out in the air bag, or a rupture of air conduit, will so reduce the line pressure as to re-lock the dog to the ratchet plate under the action of the biasing spring. The table will then be prevented from slamming down under the weight it may be carrying.

DESCRIPTION OF THE PREFERRED EMBODIMENTS

Figure 1:
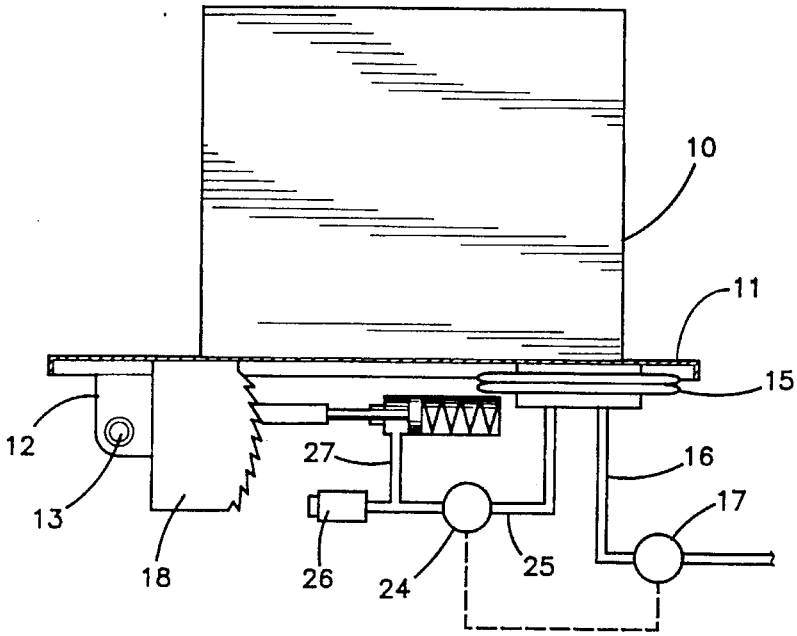
FIG. 1 is a schematic view showing the condition of the system prior to the actuation which would induce tilting.
Figure 2:
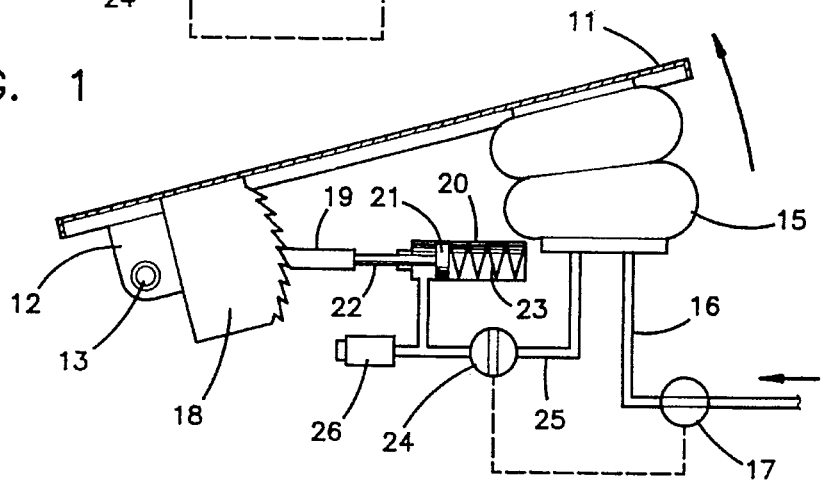
FIG. 2 is a schematic view of the same components that appear in FIG. 1, but in the position corresponding to movement of the table surface to an inclined position.

Referring to FIGS. 1–4, an object of any description is indicated at 10, representing a weight carried by the tiltable table surface 11. This table panel includes an arm 12 extending to a pivotal connection 13 providing a fulcrum on the base structure 14 shown in FIG. 5. An accordion-type air bag 15 is mounted on the base structure, and acts against the underside of the table panel 11 when it is necessary to move it to an inclined position. Compressed air is admitted to the air bag through the conduit 16 under the control of the valve 17.

A ratchet plate 18 is secured to the table panel 11, with the arcuate notched periphery concentric with the axis of the pivot 13. The inclination of the notches of the ratchet plate is selected to provide a positive lock against a return of the table surface to the horizontal position when the dog 19 is in the locking position shown in FIG. 2. A cylinder 20, also mounted on the base structure, carries a piston 21 with a piston rod 22 extending to a connection with the dog 19. The compression spring 23 biases the dog 19 into the locking position shown in FIG. 2, in the absence of significant air pressure in the cylinder in the portion to the left of the piston 21 shown in FIG. 2. As the valve 17 is set to admit air through the conduit 16 to inflate the air bag 15, the upward tilting movement of the table is accompanied by a cam action (due to the incline of the teeth of the ratchet) that moves the dog 19 to the right against the action of the spring 23. This action continues during the selected degree of extension Of the air bag 15.

Figure 3:
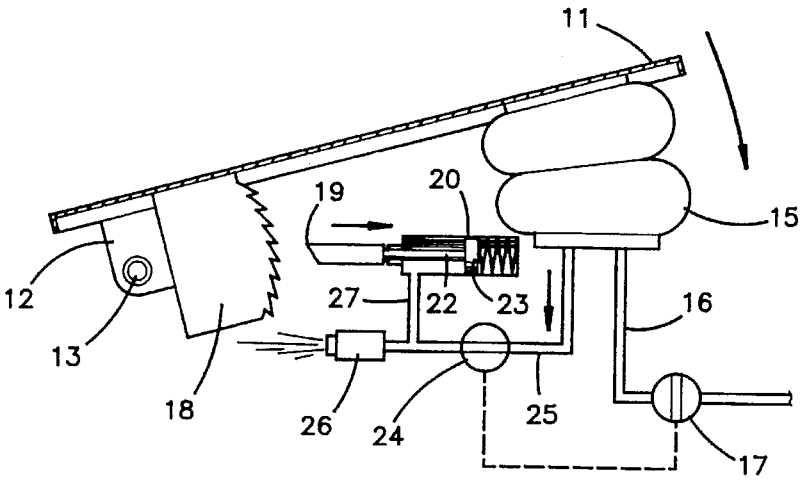
FIG. 3 is a view of the same components as appear in FIGS. 1 and 2, showing the condition of the components corresponding to a gradual lowering of the table.
Figure 4:
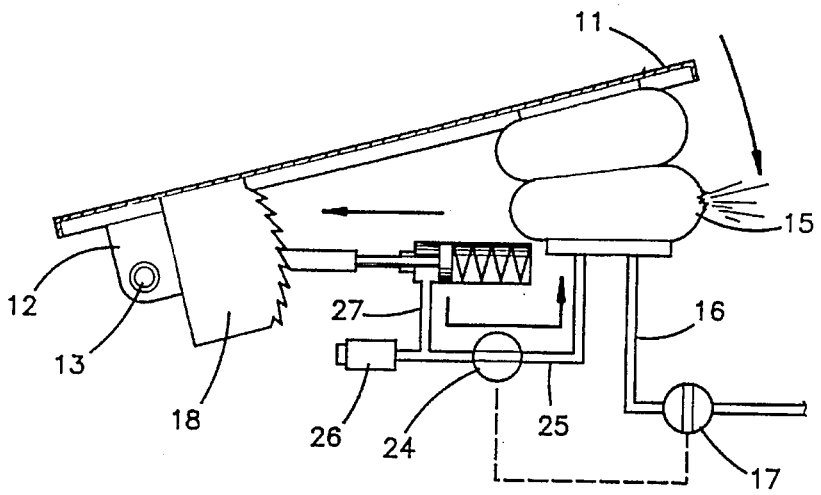
FIG. 4 is a view of the same components as appearing in FIGS. 1–3, but in the position corresponding to a rupture of an air line or the air bag actuator.

When it becomes necessary to lower the table back toward the horizontal position, the valve 17 is first checked to be sure that it is in closed position. It may well have been placed there previously, on establishment of a desired degree of tilt to the table panel. The valve 24 is then opened, permitting air to flow out through the conduit 25 from the air bag 15, and be discharged through the restricted orifice unit 26. The effect of this restricted discharge is to maintain sufficient pressure in the left end of the cylinder 20 to overcome the biasing action of the spring 23, and permit the dog 19 to withdraw from the ratchet plate 18. The exhaust pressure conditions in the air bag 15 are maintained within the cylinder 20 through the connection 27, which has the effect of placing the left side of the cylinder in parallel with the conditions in the air bag. This condition is illustrated in FIG. 3, corresponding to the gradual lowering of the table panel 11 toward a horizontal position. If the air bag 15 or the pressure conduits rupture, however, a fail-safe condition immediately sets in. Pressure in the air line 27 is suddenly reduced to the point that the action of the spring 23 instantly moves the dog 19 into the locking position shown in FIG. 4. The system will remain in this condition until the air pressure conditions are reestablished. The result of this arrangement is to prevent the table panel 11 from slamming down under the effect of the weight 10, and causing damage or injury. For convenience, the valves 17 and 24 may be combined into a single unit that can be placed in positions corresponding to the illustrated conditions.

Figure 6:
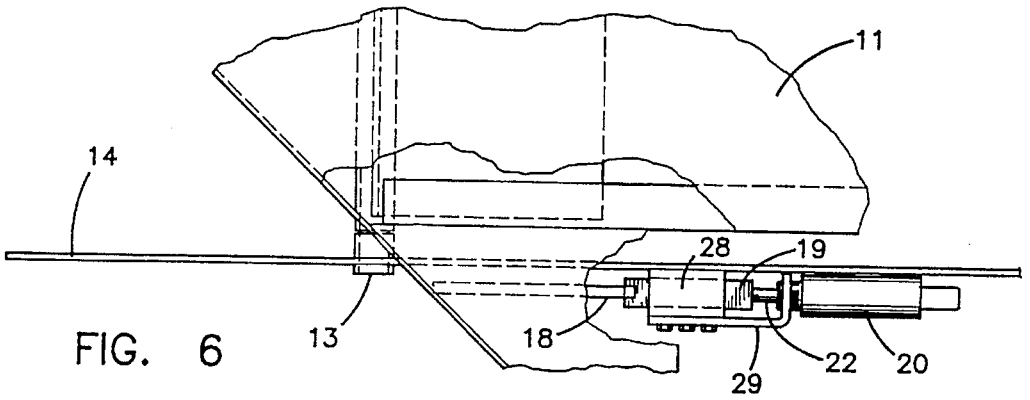
FIG. 6 is a top view of the mechanism appearing in FIG. 5.
Figure 5:
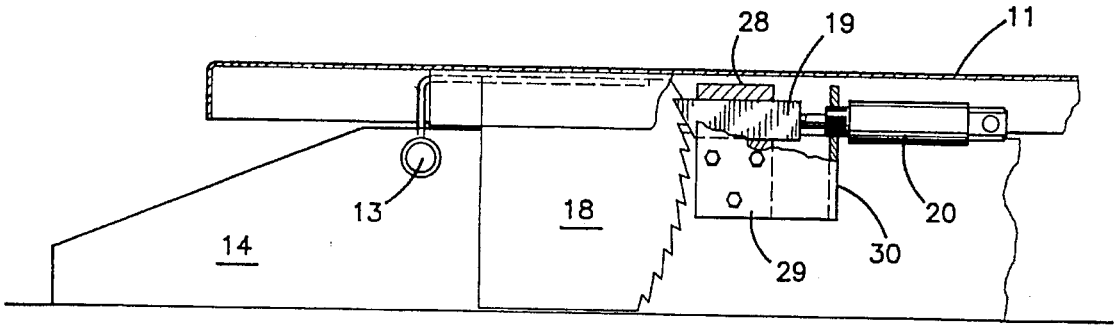
FIG. 5 is a side elevation of the locking mechanism shown in the locked position.

Referring to FIGS. 5 & 6, the dog 19 is slidably supported in a guideway structure 28 carried by the bracket 29 mounted on the base 14. The bracket also has a flange 30 on which the cylinder 20 is mounted. The mounting of this locking system will vary in detail with the particular base structure on which the tilting table is supported. It should be noted that a natural biasing system is continually present urging the table panel to a horizontal position in opposition to the actuating system. This is due to the effect of the weight on the table panel, and the weight of the panel itself. These forces will normally be eccentric to the pivotal mounting of the table.

A second embodiment of the invention is shown in FIGS. 7–10. Parts that are the same as in previous embodiments are given the same numbers. In this embodiment, the valves are combined into a single unit preferably in the form of a spool or shuttle valve 40. Shuttle valve 40 is manually actuatable by an actuating button 42 that shifts the valve between the positions shown in FIG. 7 and the position shown in FIG. 9. When in the position shown in FIG. 7, valve 40 is shifted to the right so that an outlet 44 of pneumatic cylinder 20 is vented through passage 44 in the valve to exhaust conduit 45 which leads to atmosphere. A source of compressed air 48 is connected to passage 46 in valve 40 and this leads to conduit 50 which in turn is connected to air spring 15. A pressure regulator 52 and flow restricter valve 54 (both shown schematically) regulate the air pressure and rate of air flow to and from the air spring.

Figure 7:
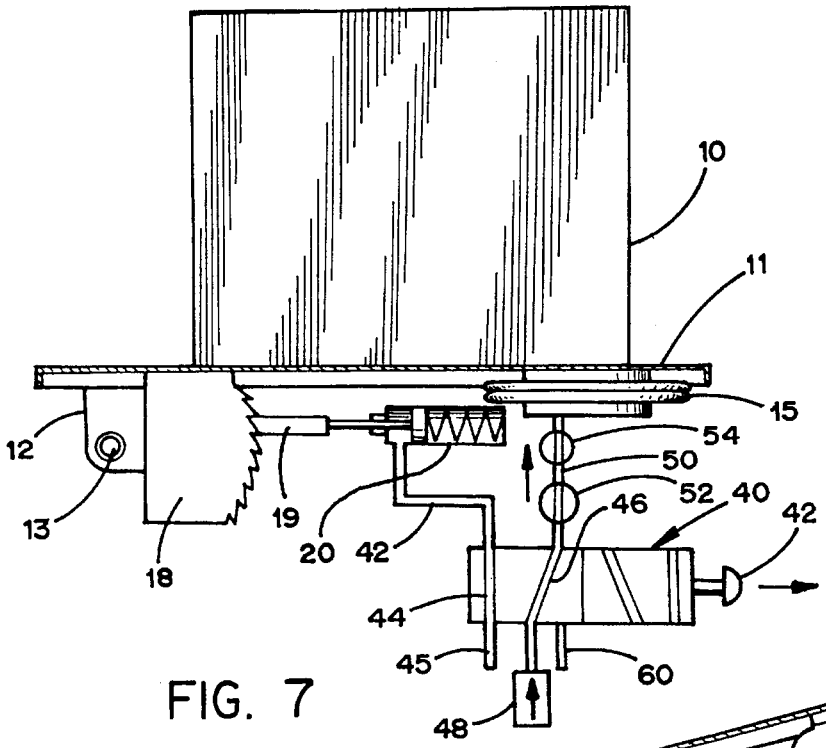
FIG. 7 is a schematic view of a second embodiment showing the condition of the system prior to the actuation which would induce tilting.
Figure 8:
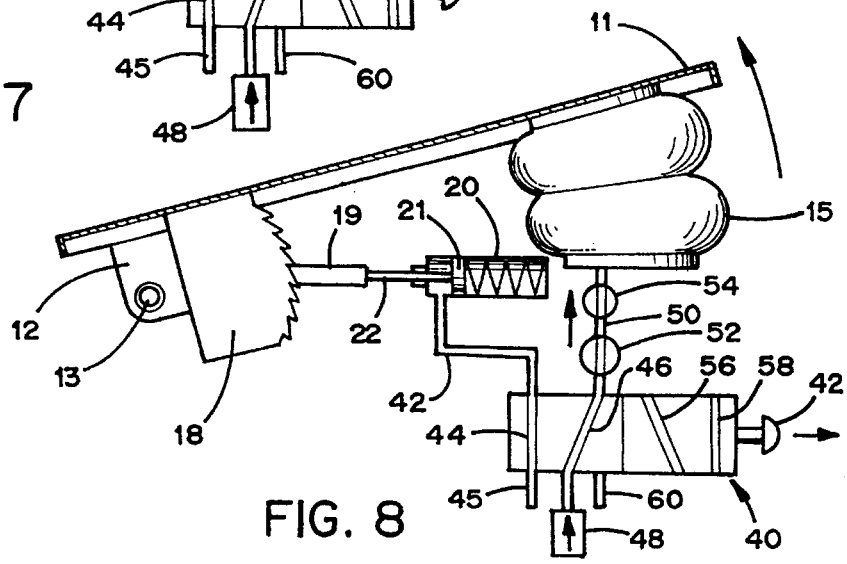
FIG. 8 is a schematic view of the same components that appear in FIG. 7, but in the position corresponding to movement of the table surface to an inclined position.

When the valve is positioned to the right, as shown in FIG. 7, air pressure is directed to the air spring to inflate the air spring, while no air pressure is directed to the pneumatic cylinder 20, thus leaving the ratchet latch between dog 19 and ratchet plate 18 locked. This permits the table to be raised, as shown in FIG. 8 but prevents the table from lowering.

Figure 9:
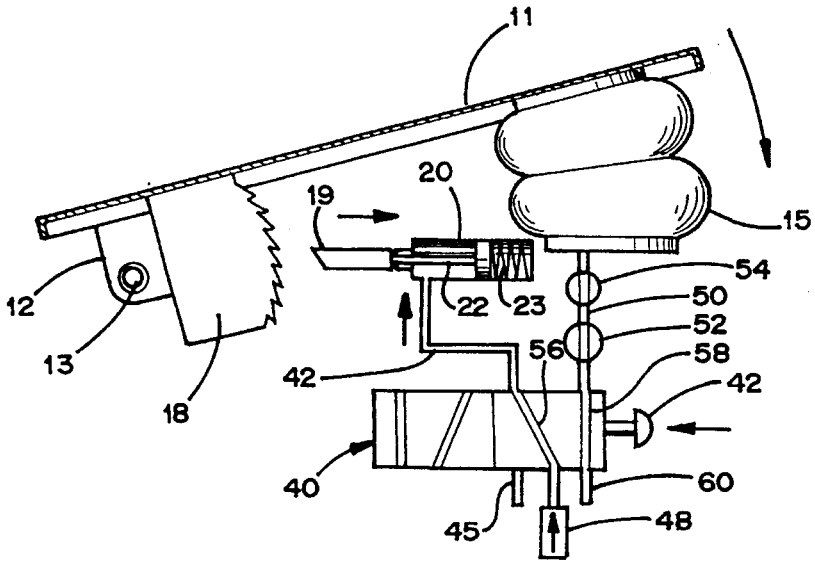
FIG. 9 is a view of the same components as appear in FIGS. 7 and 8, showing the condition of the components corresponding to a gradual lowering of the table.

When the actuating button 42 or spool is shifted to the left, as shown in FIG. 9, passage 56 in the right hand side of the valve connects the pressurized air supply to conduit 42 leading to cylinder 20. This shifts piston 20 to the right, compressing spring 23 and retracting or releasing dog 19 from ratchet plate 18. At the same time, passage 58 in the right hand section of the valve connects conduit 50 leading from air spring 15 to exhaust conduit 60 leading to atmosphere. This releases the pressure in air bag 15 and permits a gradual deflation of the air bag, with the flow being restricted by flow restricter 54.

Figure 10:
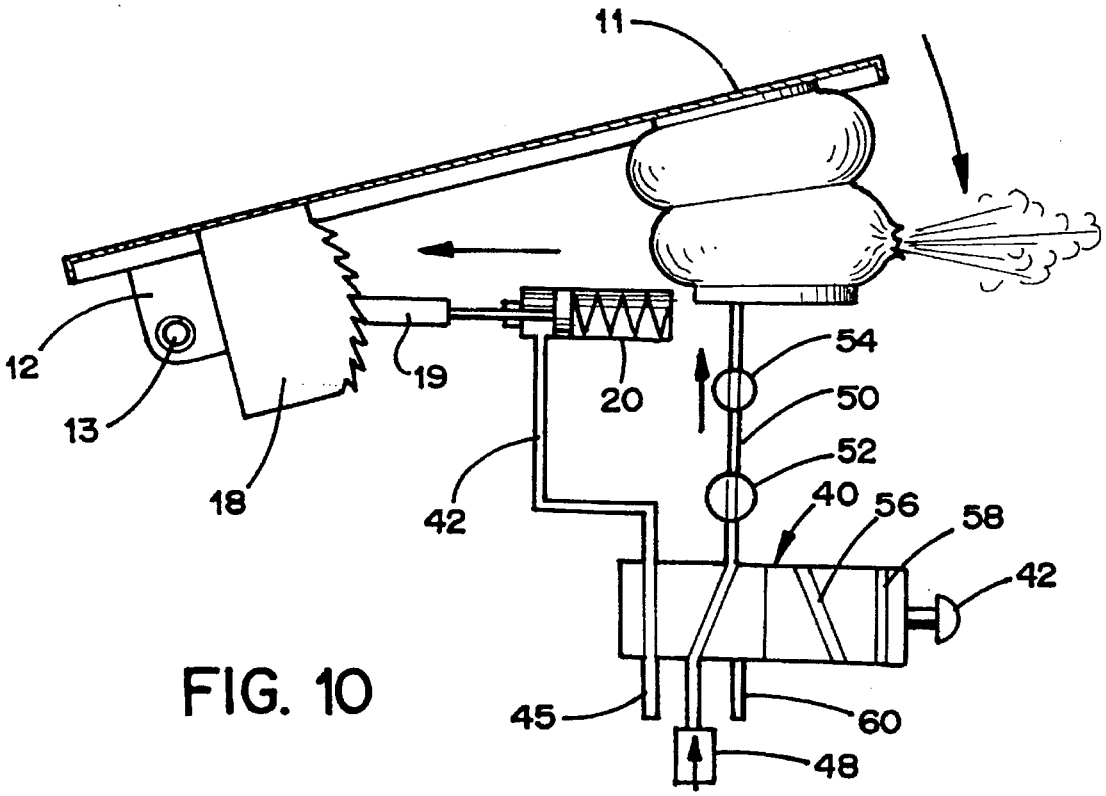
FIG. 10 is a view of the same components as appearing in FIGS. 7–9, but in the position corresponding to a rupture of an air line or the air bag actuator.

In most situations, it has been found that the air bag fails at the time that air pressure is being introduced into the air bag, which occurs during inflation of the bag. As shown in FIG. 10, if the air spring or inlet air conduit fails during inflation of the bag, dog 19 is still engaged in ratchet plate 18 so that the locking device continues to hold the table 11 in position, even though the air pressure. circuit fails.

In operation, the spool valve is first manually moved to the right so that the air spring can be inflated, and then the spool valve is moved to the left in order to lower the table.

The foregoing is exemplary of the preferred practice of the present invention. However, various changes and modifications may be made in the arrangements and details of construction of the embodiments disclosed herein without departing from the spirit and scope of the present invention, which is defined in the appended claims.

I claim:

1. A safety locking system for a fluid operated tilt table wherein the tilt table comprises a tilting table top pivotally mounted on a base for movement between a horizontal position and an upwardly inclined position, the tilt table further comprising a fluid operated lift means for lifting and lowering the table top with respect to the base, the lift means being such that there is an elevated internal fluid pressure in the lift means when the table top is supported in an elevated position above the base by the lift means, the safety locking system comprising:

a releasable mechanical latch means for preventing the table top from lowering from a raised position toward the base when the latch means is engaged, the latch means comprising a one-way ratchet latch that allows the table top to be raised but not lowered when the latch means is engaged and permits the table top to be lowered only when the latch means is released; and latch actuator means for engaging and releasing the latch means, the latch actuator means including:

resilient biasing means for urging the latch means toward its engaged position; and fluid operated latch release means for urging the latch means toward its released position, the latch release means being actuated so as to cause the latch means to become released when the latch release means is pressurized with sufficient fluid pressure to overcome the resilient biasing means, the latch means holding the table top in its elevated position and preventing the table top from falling down if fluid pressure is lost in the lift means while pressure is being applied to the lift means, the latch release means being actuated to release the latch when the table is lowered.

2. A safety locking system according to claim 1 wherein the fluid is gas.

3. A safety locking system according to claim 1 wherein the fluid is air.

4. In combination with a base and a member movably mounted for upward and downward movement on the base, a fail-safe actuating system including a pneumatic pressure actuator that raises the member upwardly when actuated and lowers the member downwardly when deactuated, and a locking device operable to fix the relative position of said base and said member, wherein the locking device comprises:

a pneumatic piston-cylinder unit mounted on one of said base structure and said member;

a one-way ratchet mechanism interconnecting the member and the base and having locking and released positions, the ratchet mechanism permitting the member to be raised but not lowered when in its locking position and permitting the member to be lowered when in its released position, the ratchet mechanism being moved by said piston-cylinder unit to its released position in response to a predetermined pressure within said pneumatic piston-cylinder unit;

biasing means urging said ratchet mechanism to remain in the locking position in the absence of the predetermined pressure in the pneumatic piston-cylinder unit; and means for operating the pneumatic piston-cylinder unit to move the ratchet mechanism to its released position when the pneumatic pressure actuator is deactuated.

* * * * *